US006073966A

United States Patent [19]

Warren

[11] Patent Number: 6,073,966

[45] Date of Patent: Jun. 13, 2000

[54] BOOK WITH SLIDING TOY

[75] Inventor: Candy Warren, Bethel, Conn.

[73] Assignee: Joshua Morris Publishing, Inc., Westport, Conn.

[21] Appl. No.: 09/055,182

[22] Filed: Apr. 3, 1998

[51] Int. Cl.[7] ..... B42D 3/00

[52] U.S. Cl. ..... 281/37; 281/51; 281/42; 116/239

[58] Field of Search ..... 281/42, 45, 37, 281/51, 29; 402/70, 73, 4, 80 R; 116/238, 239

[56] References Cited

U.S. PATENT DOCUMENTS 2,585,421 2/1952 Dumais ..... 281/42

5,022,342 6/1991 Davis ..... 281/42 X 5,622,387 4/1997 Ordway ..... 281/42

*Primary Examiner*—Willmon Fridie, Jr.

*Attorney, Agent, or Firm*—Kenyon & Kenyon

[57] ABSTRACT

A book-toy combination, comprising a front cover, a back cover, and a plurality of pages therebetween, the front cover, back cover and plurality of pages being bound along one side thereof; an elongated member coupled to at least one of the front cover, the back cover, and at least one of the plurality of pages, the elongated member extending away from a periphery of the front cover, the back cover, and the at least one of the plurality of pages; and at least one element sliding along the elongated member.

26 Claims, 8 Drawing Sheets

BOOK WITH SLIDING TOY

FIELD OF THE INVENTION

The present invention relates to a book with a sliding toy, and in particular to an interactive children's book with a sliding toy.

BACKGROUND INFORMATION

There are many conventional devices used in the field of children's books to attract and maintain an attention span of children. A commonly used conventional device provides a large, colorful illustrations showing the subject matter (e.g., a story) of the book or providing an eye-catching and amusing background for the story.

Another such conventional device is described in U.S. Pat. No. 4,819,963, which describes a book sculptured in the shape of a fish or other form, apparently for the purpose of gaining the interest of children. However, it would be desirable to further attract the interest of children in order to encourage children to read.

SUMMARY OF THE INVENTION

Accordingly, one of the objects of the present invention is to provide a book having a slidable toy for attracting the attention and interest of a child.

This object can be achieved by providing a book in which at least one toy is slidably mounted on an elongated member which is coupled to the book.

It is a further object of the present invention to provide such a book wherein the at least one toy slidable member is slidably mounted on the elongated member so that the toy slidable member may also rotate around the elongated member in addition to slidably moving along the elongated member.

It is yet a further object of the present invention to provide such a book wherein the at least one toy slidable member has a shape relating to the subject matter of the book.

These and other objects of the present invention, which will become apparent from the following detailed description, are achieved as follows. The present invention provides a book having a front cover, a back cover, and a plurality of pages therebetween, all of which are bound together. A set of toy members are slidably mounted on a semicircular elongated member which is then coupled to one of the front cover, the back cover and one of the plurality of pages. For this purpose, the cover(s) or page(s) which are coupled to the elongated member may be provided with sufficient structural integrity to support the weight of the elongated member and the toy slidable members. For example, the cover or page coupled to the elongated member may be thicker or be comprised of a material that is sturdier than the other portions of the book. The toy slidable members may have shapes relating to the subject matter of the book, or any other shape that may be attractive and amusing to children.

DETAILED DESCRIPTION OF THE INVENTION

Figure 1A:
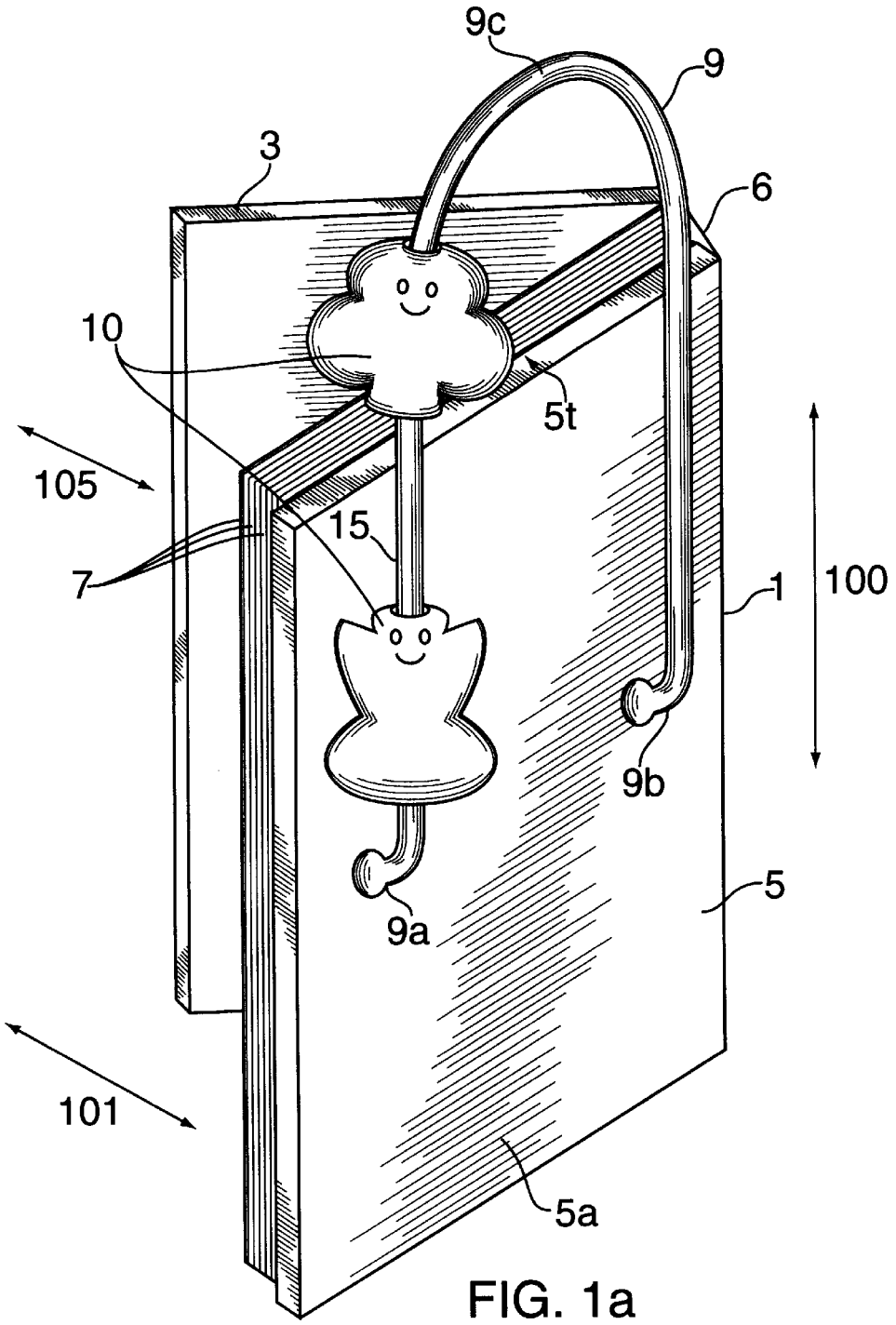
FIG. 1*a* shows a perspective view of a book according to the present invention.
Figure 1B:
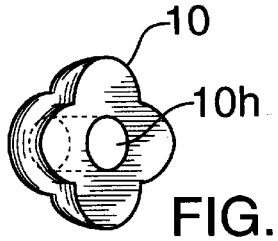
FIG. 1*b* shows a top view of a toy member.

FIG. 1 shows a perspective view of a book 1 according to the present invention. The book 1 includes a front cover 3, a back cover 5, and a plurality of pages 7. The front cover 3, the back cover 5 and the plurality of pages 7 may include a written story and/or illustrations thereon to maintain a user's (e.g., a child's) interest. The front cover 3, the back cover 5 and the plurality of pages 7 are bound along one common side thereof by a binding 6 in a conventional manner. The binding 6 may be any conventional binding such as glue, staples, rings, etc. As in any conventional book, binding 6 permits the front cover 3, the back cover 5 and the plurality of pages 7 to be turned. In a first embodiment according to the present invention, the front cover 3, the back cover 5 and the plurality of pages 7 may be made of a rigid material, such as a cardboard material or a plastic material, to provide a structural integrity to the book 1. Since the cardboard material is resistant to tearing, the cardboard material in the front cover 3 and the back cover 5 (and possibly the plurality of pages 7) will render the book 1 sturdy and tear-resistant, and hence particularly suitable for a young child. In an alternative embodiment, the front cover 3, the back cover 5 and the plurality of pages 7 may include a thin material overlay stretched over a rigid material insert such as a cardboard material or a plastic material.

An elongated member 9 (e.g., a elongated member) which facilitates at least one toy slidable member 10 to be slidable thereon is coupled to the book 1. In the embodiment shown in FIG. 1*a*, a first end 9*a* and a second end 9*b* of the elongated member 9 is fixedly coupled to an outer face 5*a* of the back cover 5. The elongated member 9 has a substantially semicircular shape extending on a first plane 100 parallel to the outer face 5*a* of the back cover 5, although the first end 9*a* and second end 9*b* curves substantially along a second plane 101 extending substantially perpendicular to the first plane 100 for coupling to the back cover 5. However, it is possible that the elongated member 9 may curve across a different plane or may have multiple curves across multiple planes. In this manner, the elongated member 9 may have a more complex and ornate design than the elongated member 9 shown in FIG. 1. It is also possible for the elongated member 9 to be alternatively, or additionally, coupled to an inner face 5*b* of the back cover 5, the front cover 3 and/or one of the plurality of pages 7. If the elongated member 9 is coupled to the inner face 5*b* and/or one of the plurality of pages 7, the plurality of pages 7 may be further bound to accommodate the additional space necessary to situate the elongated member 9 and its attachments. The elongated member 9 may be made of a rigid material such as plastic, wood, etc., so that it retains its shape. It is also possible that the elongated member 9 may be made of a semi-rigid posable material which allows the user of the book to bend the elongated member 9 into a desired shape, and the elongated member 9 would retain such a desired shape.

An upper portion of the elongated member 9 may extend above a top edge 5*t* of the back cover 5 so that the elongated member 9 may be visible and accessible to the user (i.e., the child) reading the book 1. In addition to the above described functions, this arrangement enables the elongated member 9 to be used as a "handle-like" device for easier carrying or handling of the book 1.

A set of toy members 10 may be slidably mounted on the elongated member 9 so that each of the toy members 10 may slide along an extending portion 9*c* of the elongated member 9 between an area adjacent to the first end 9*a* and an area adjacent to the second end 9*b* of the elongated member 9. Each of the set of toy members 10 may be manufactured with varying or similar shapes. In particular, each of the set of toy members 10 may have a shape relating to the subject matter of the book 1, or may a shape that is designed to be appealing or amusing to the user of the book 1. As shown in FIG. 1*a*, each of the set of toy members 10 is provided with a cylindrical bore 10*h* extending through a longitudinal axis 102 of the toy member 10 to allow the toy member 10 to be slidably mounted on the elongated member 9. The bore 10*h* may have a cross-section greater than a cross-sectional diameter of the elongated member 9 so that the toy member 10 is capable of sliding along the extending portion 9*c* of the elongated member 9. In addition, the cross-section of the toy member 10 should be adequate to allow the toy member 10 spin about the extending portion 9*c* of the elongated member 9. Thus, in addition to a slidable movement along the elongated member 9, the arrangement according to the present invention facilitates a rotating movement about the elongated member 9 to provide further interaction for the user. In order to facilitate this rotating movement, the elongated member 9 has a substantially circular cross-section, although other cross-sectional shapes may also be used which allow the set of toy members 10 to rotate and slide about the elongated member 9. Due to the perpendicular arrangement of the first end 9*a* and the second end 9*b* of the elongated member 9 in relation to the extending portion 9*c*, the extending portion 9*c* extends along a first axis 105 on the second plane 101 for a predetermined distance h from the outer face 5*a* of the back cover 5. This predetermined distance h should be sufficient to allow the set of toy members 10 to travel a full path along the semicircular portion of the elongated member 9 between a point immediately adjacent to one of the first end 9*a* and the second end 9*b* to the point immediately adjacent to another one of the first end 9*a* and the second end 9*b*, without being obstructed by the outer face 5*a* of the back cover 5.

Figure 2B:
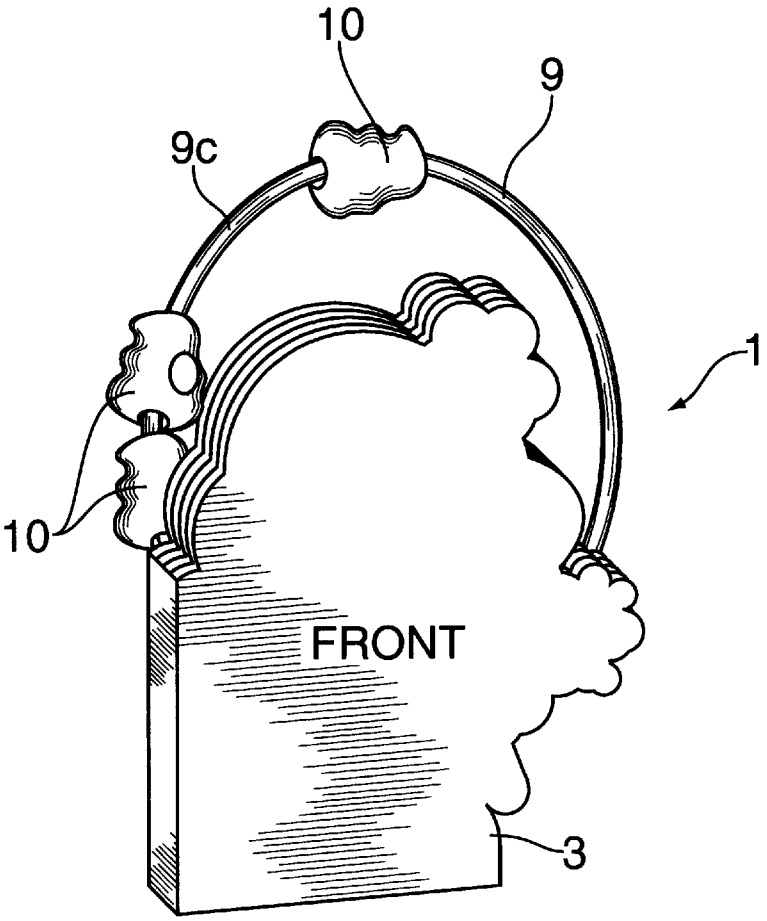
FIG. 2*b* shows a front view of the book illustrated in FIG. 2*a*.
Figure 2A:
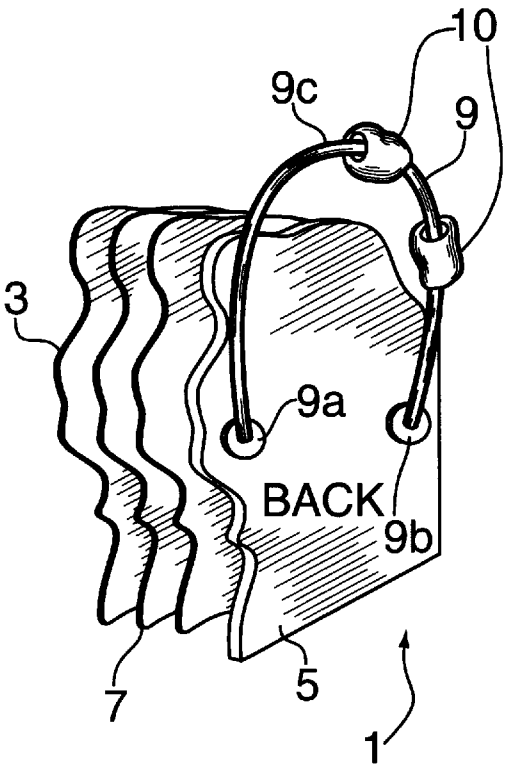
FIG. 2*a* shows a rear view of an alternative embodiment of the book according to the present invention.

FIG. 2 shows an alternative embodiment in which the front cover 3, the plurality of pages 7, and the back cover 5 are provided in a shape that may correspond to the subject matter of the book 1 or other arbitrary, appealing shape to provide further enjoyment to the user. The book 1 may be provided with any one of the front cover 3, back cover 5 and the plurality of pages 7 with such shape.

Figure 3:
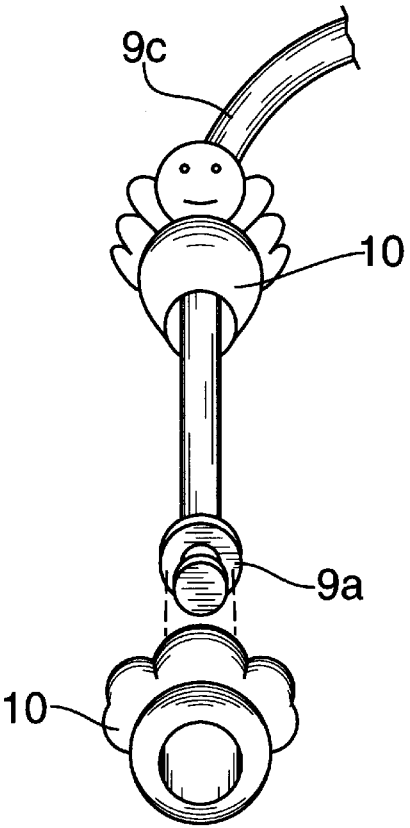
FIG. 3 shows a set of toy members being mounted on the book illustrated in FIGS. 1*a*, 1*b*, 2*a*, and 2*b*.

FIG. 3 shows how the toy members 10 are mounted on the elongated member 9 before the elongated member 9 is coupled to the book 1. The set of toy members 10 may be mounted onto the elongated member 9 by sliding each one of the set of toy members 10 over the first end 9*a* and/or the second end 9*b* through the bore 10*h*. Thus, the bore 10*h* on each one of the set of toy members 10 should have a sufficient cross-section to allow each one of the set of toy members 10 to be individually slid over the first end 9*a* and/or over the second end 9*b*, and then onto the extending portion 9*c* of the elongated member 9.

Figure 4A:
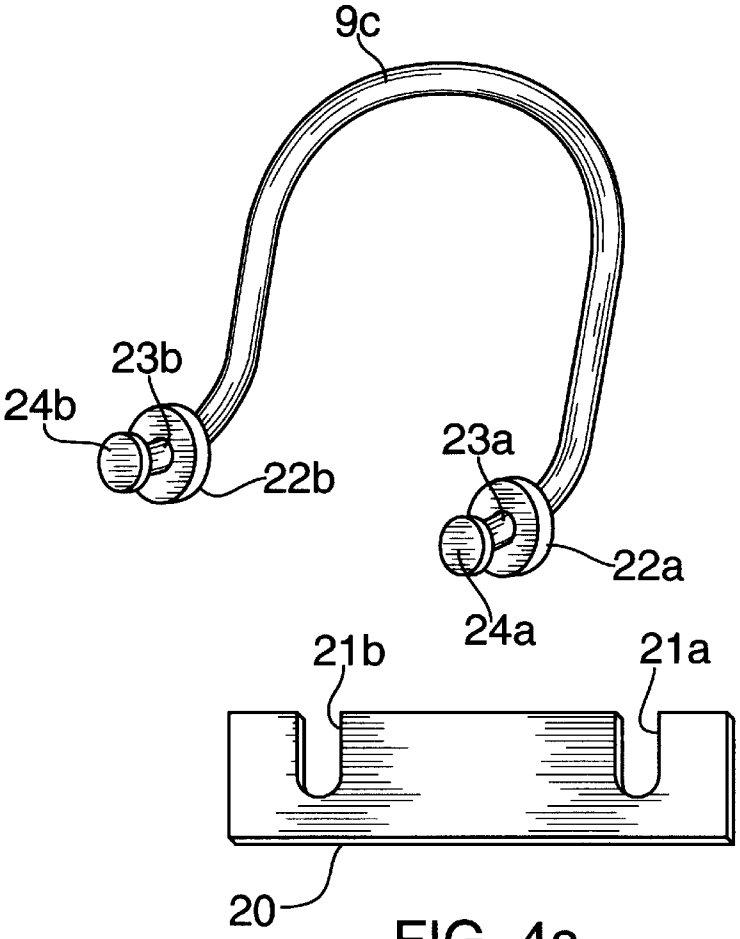
FIG. 4*a* shows a first exemplary set of coupling devices for coupling an elongated member facilitating a sliding action to the book.

FIG. 4*a*shows a first connecting arrangement coupling the elongated member 9 to the back cover 5. The first connecting arrangement includes a clip 20 having a first notch 21*a* and second notch 21*b*. The first connecting arrangement also includes the first end 9*a* and the second end 9*b* of the elongated member 9, each having a set of caps 22*a*, 22*b*, resting portions 23*a*, 23*b*, and flanges 24*a*, 24*b*. The caps 22*a*, 22*b* and the flanges 24*a*, 24*b* may have a cross-section larger than the cross-section of the resting portions 23*a*, 23*b*.

The first notch 21*a* on the clip 20 is separated a second predetermined distance from the second notch 21*b*. The second predetermined distance corresponding to the distance between the first end 9*a* and the second end 9*b* of the elongated member 9. Each of the first and second notches 21*a*, 21*b* may also have a width substantially corresponding to the cross-sectional diameter of the resting portions 23*a*, 23*b* so that the resting portions 23*a*, 23*b* may be received within the respective notches 21*a*, 21*b*. The clip 20 may be made from a rigid material such as plastic, wood, cardboard, etc. to maintain its structural integrity under stress.

The flange 24*a* may be disposed on a tip of the first end 9*a*, and the cap 22*b* may be disposed at a third predetermined distance from the flange 24*a*extending along the first end 9*a*. The third predetermined distance is larger than the depth of the clip 20 in the back cover 5 and smaller than the overall depth of the back cover 5. A similar arrangement may be provided on the second end 9*b*.

Figure 4B:
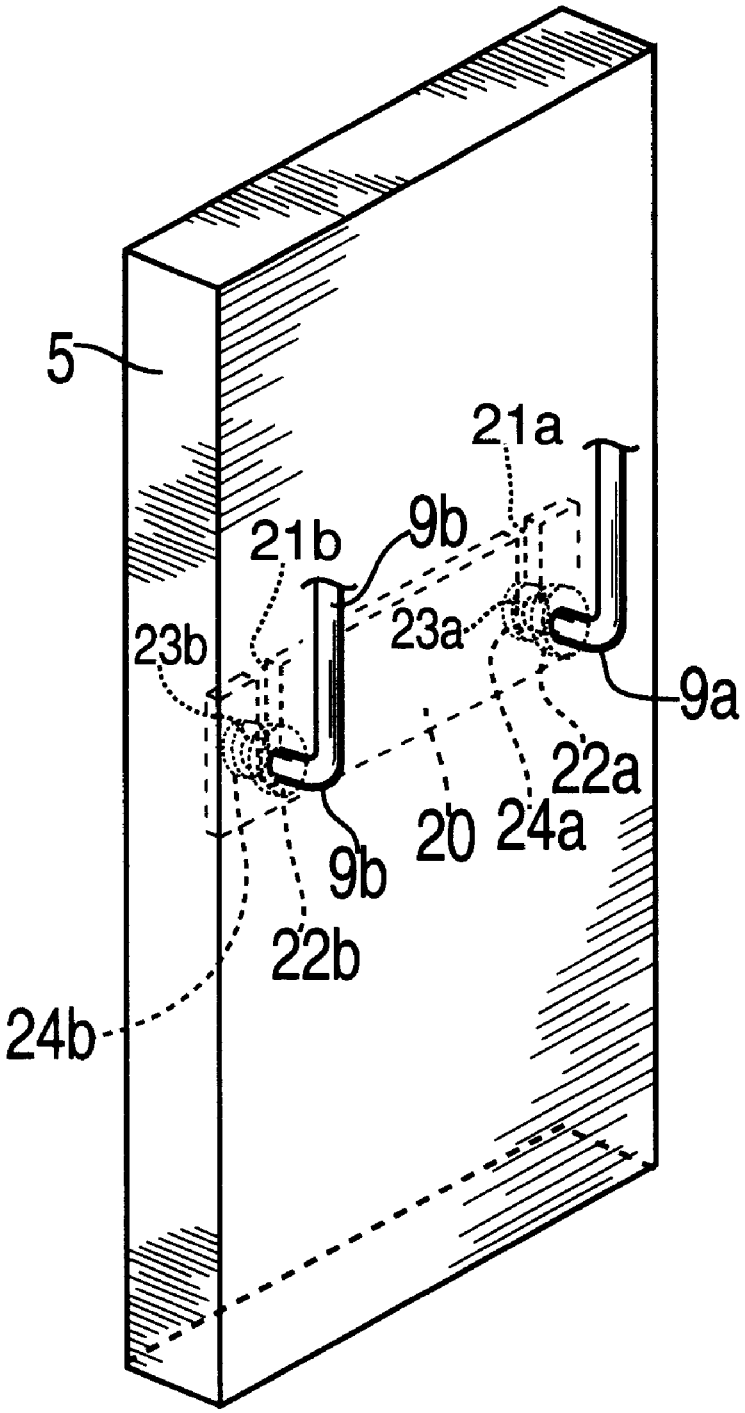
FIG. 4*b* shows the first exemplary set of coupling devices illustrated in FIG. 4 being engaged with one another.

An assembled connecting arrangement situated in the back cover 5 of the book 1 is shown in FIG. 4*b* . The clip 20 may be embedded within the back cover 5, along with the set of caps 22*a*, 22*b*, the resting portions 23*a*, 23*b*, and the flanges 24*a*, 24*b* of the first and second ends 9*a* and 9*b*. The first resting portion 23*a* of the first end 9*a* and the second resting portion 23*b* of the second end 9*b* are received within respective notches 21*a*, 21*b*. In this arrangement, the clip 20 acts as a stress-distributing elongated member, distributing the supporting weight of the elongated member 9 across the horizontal length of the back cover 5 to prevent the stress from being concentrated only in the areas of the back cover 5 which is directly coupled to the elongated member 9. In addition, the flanges 24*a*, 24*b* and caps 22*a*, 22*b* are designed to securely hold the first and second ends 9*a*, 9*b* of the elongated member 9 on the back cover 5. Further portions of the elongated member 9 situated between the first and second ends 9*a*, 9*b* and the extending portion 9*c* may extend from of the back cover 5 to allow the set of toy members 10 to be slid between the back cover 5 and the extending portion 9*c* in the areas adjacent to the first end 9*a* and the second end 9*b*.

In an alternative embodiment, the clip 20 may be attached onto the outer face 5*a* of the back cover 5 using conventional means such as glue, tape, etc., without embedding the clip 20 within the back cover 5. Accordingly, the elongated member 9 would be received within the notches 21*a*, 21*b* so that only the flanges 24*a*, 24*b* and a segment of the resting portions 23*a*, 23*b* may be embedded within the back cover 5, and the caps 22*a*, 22*b* may directly abut the clip 20. Using this arrangement, structural support is provided to the elongated member 9/back cover 5 connection similar to the support provided in the embodiment described above.

FIGS. 5*a*–5*d* shows yet another connecting arrangement for coupling the elongated member 9 to the back cover 5, which includes a board 42 and a set of caps 40*a*, 40*b* embedded within the back cover 5, and an engaging tip 30 provided on each one of the first and second ends 9*a*, 9*b*.

Figure 5A:
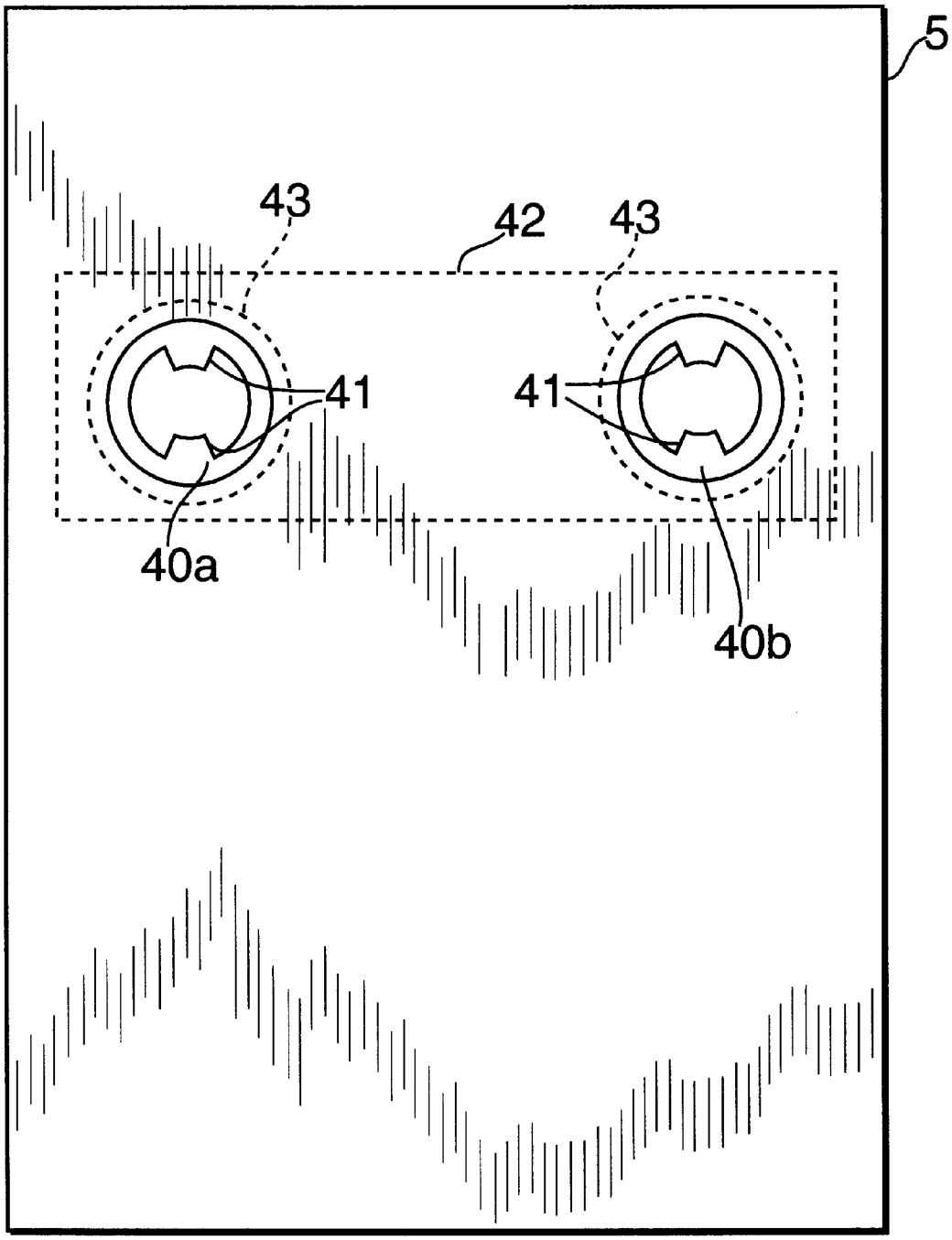
FIG. 5*a* shows a second exemplary set of coupling devices for coupling the elongated member to the book.

In particular, FIG. 5*a* shows a front view of the back cover 5 in which the board 42 is embedded substantially in a center of the back cover 5. The board 42 may be made from a rigid material such as plastic, wood, cardboard, etc. The set of caps 40*a*, 40*b* extend through a portion of the back cover 5 and through the board 42 as shown in FIGS. 5*a*–5*c*.

Figure 5B:
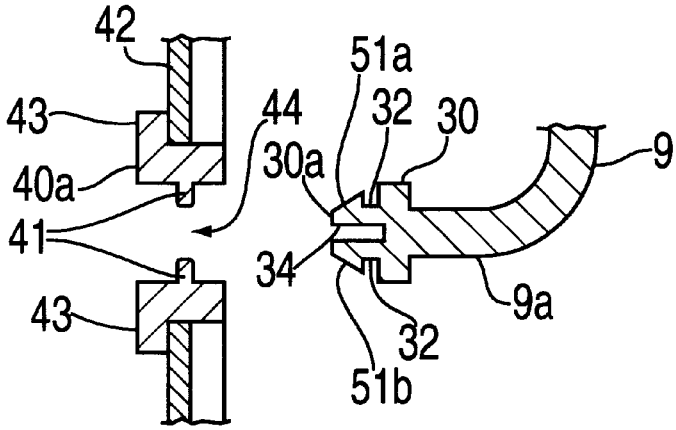
FIG. 5*b* shows a pre-attached configuration of the second set of coupling devices illustrated in FIG. 5*a*.
Figure 5C:
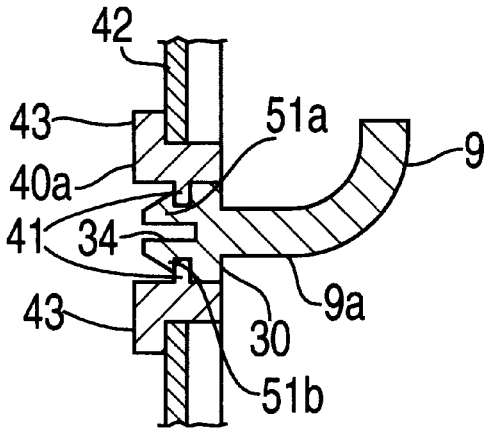
FIG. 5*c* shows an attached configuration of the second set of coupling devices illustrated in FIGS. 5*a* and 5*b*.

As shown in FIGS. 5*a* and 5*b*, the cap 40*a* has a substantially cylindrical shape with a lip portion 43 situated on an interior side of the board 42. The lip portion 43 secures the elongated member 9, which is later received within the cap 40*a*, by coupling (e.g., anchoring) the cap 40*a* to the board 42. A cylindrical receiving bore 44 extends through the cap 40*a* for receiving the first end 9*a* of the elongated member 9. A set of tongue members 41 may be provided within the receiving bore 44, which are situated along a top and bottom portions of the receiving bore 44 (i.e., along a periphery of the receiving bore 44) extending substantially to a center of the receiving bore 44.

Figure 5D:
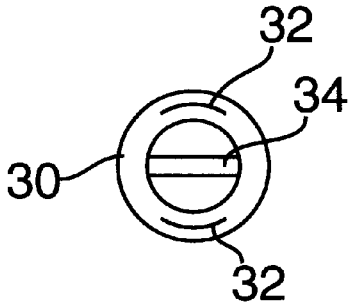
FIG. 5*d* shows a second member of the second set of coupling devices.

The engaging tip 30 is provided on the first end 9*a* of the elongated member 9 to engage with the cap 40*a*. The engaging tip 30 may have a substantially cylindrical, tapered shape as shown in FIG. 5*b*. However, a set of grooves 32 may be located on a top and bottom portions of the engaging tip 30 (as shown in FIGS. 5*b* and 5*d*). In addition, a slit 34 is formed on the distal end 30*a* of the engaging tip 30 extending between the left-most edge to the right-most edge to bisect the distal end 30*a*. The slit 34 extends into the engaging tip 30 to a point substantially corresponding to the position of the set of grooves 32. The slit 34 may also extend beyond the set of grooves 32.

In operation, the engaging tip 30 is inserted into the receiving bore 44. The tapered shape of the engaging tip 30 allows the engaging tip 30 to slide through the tongue members 41 on the cap 40*a*. As the cross-sectional area of the engaging tip 30 increases, the engaging tip 30 would experience a vertical compression (i.e., upward and downward). The slit 34 would allow a first half portion 51*a* and a second half portion 51*b* of the engaging tip 30 to be vertically compressed and bypass the tongue members 41 until the tongue members 41 engage with the grooves 32 on the engaging tip 30. Since the set of grooves 32 are engaged with the tongues 41, the insertion of the engaging tip 30 is stopped. In particular, the walls of the grooves 32 are spaced apart so that the tongue members 41 are tightly engaged within the grooves 32, thereby securing the first end 9*a* (and therefore the elongated member 9) within the cap 40*a* as shown in FIG. 5*c*.

A similar arrangement is provided for securing the second end 9*b* within the cap 40*b*.

It is possible to provide the engaging tip 30 of the elongated member 9, the receiving bore 44, and the tongue members 41 so that the engaging tip 30 is detachably received within the receiving bore 44, which would allow further modifications of the book 1. For example, this would enable the elongated member 9 to be removed and a different elongated member 9 design to be attached. In addition, the existing elongated member 9 may be removed and the set of toy members 10 may be remounted, replaced and/or added.

Figure 6A:
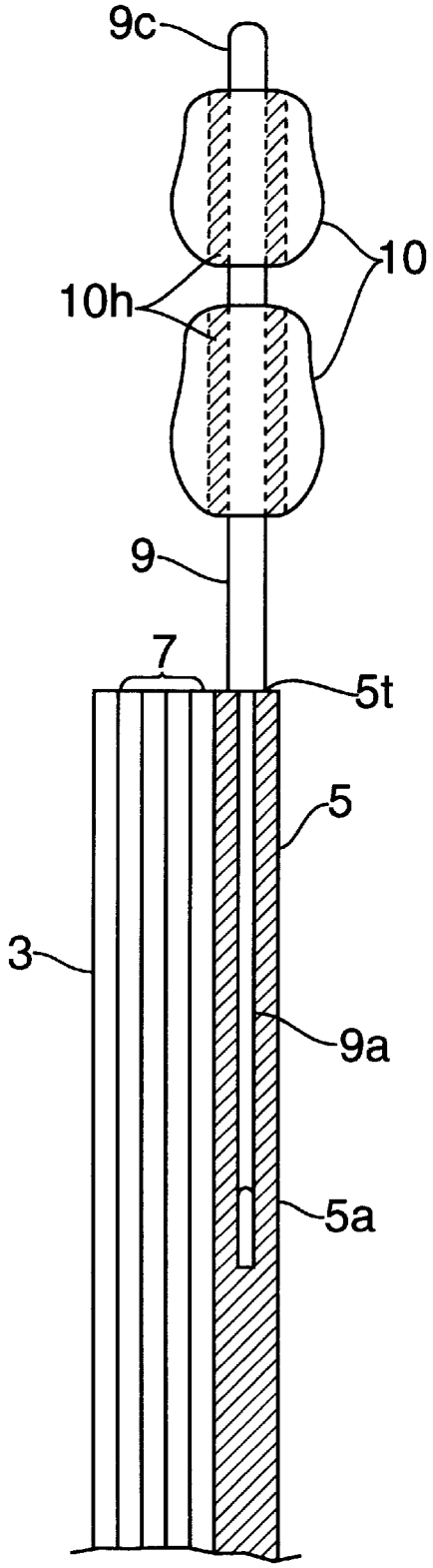
FIG. 6*a* shows a side view of a further embodiment of the book according to the present invention.
Figure 6B:
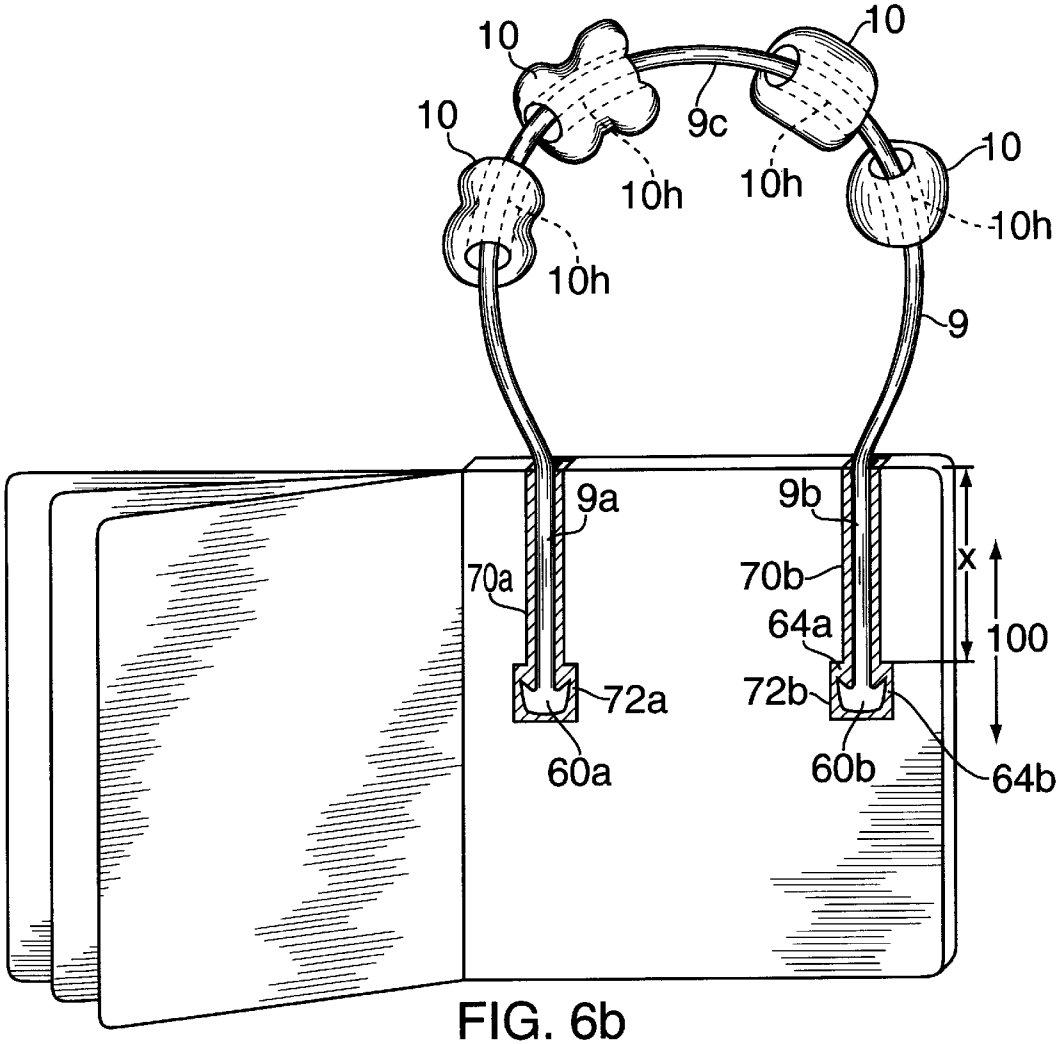
FIG. 6*b* shows a front view of the embodiment illustrated in FIG. 6*a* with a further view of a back cover.
Figure 6C:
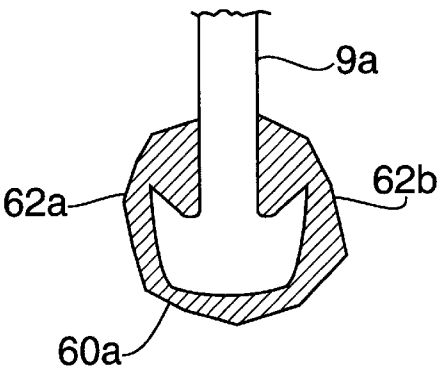
FIG. 6*c* shows an enlarged view of an end of a hoop coupled to the back cover illustrated in FIG. 6*b*.

FIGS. 6*a*–6*c* show a further embodiment of a book according to the present invention. In particular, the elongated member 9 in this embodiment is extended through the top edge 5*t* of the back cover 5. As shown in FIG. 6*b* , the first end 9*a* of the elongated member 9 is received within a first channel 70*a* extending from the top edge 5*t* of the back cover 5, and extending along the first plane 100 for a predetermined distance x. The first channel 70*a* has a substantially rectangular first locking seat (e.g., chamber) 72*a*. A subsantially similar arrangement (a second channel 70*b*, and a second locking seat 72*b*) is provided to receive the second end 9*b* of the elongated member 9.

The elongated member 9 in this embodiment may be made of a semi-compressible material such as, for example, nylon, etc., which is capable of retaining a desired shape and can also be cross-sectionally compressed to decrease a cross-sectional size of the elongated member 9. As shown in FIG. 6*a*, the first channel 70*a* and the second channel 70*b* are preferably provided with cross-sections smaller than the cross-section of the first and second ends 9*a*, 9*b* of the elongated member 9, which allows a more secure coupling when the first end 9*a* and the second 9*b* of the elongated member 9 are received within the first channel 70*a* and the second channel 70*b*, respectively, on the back cover 5. In order to further secure the elongated member 9 to the back cover 5, the first end 9*a* and the second end 9*b* of the elongated member 9 are provided with a first securing end 60*a* and a second securing end 60*b*. As shown in FIG. 6*c*, the first securing end 60*a* has two hooks 62*a*, 62*b* which point toward the top edge 5*t* of the back cover 5 when the securing end 60*a* is situated in the first locking seat 72*a*, and extend along the first end 9*a* of the elongated member 9. In operation, the first end 9*a* of the elongated member 9 (with the first securing end 60*a*) is inserted into the first channel 70*a*. Since the first end 9*a* of the elongated member 9 (and other elements of the elongated member 9) are composed of a semi-compressible material, the first end 9*a* and the first securing end 60*a* are compressed to allow them to be inserted into the first channel 60*a*. When the first securing end 60*a* reaches the first locking seat 72*a* (which is preferably larger than the first securing end 60*a*), the first securing end 60*a* returns to its original shape. As such, the hooks 62*a*, 62*b* situated on the first securing end 60*a* will maintain the first end 9*a* of the elongated member 9, and prevent the first end 9*a* from being pulled out from the channel 70*a*. It is also possible to apply glue (or other similar substances) in the first locking seat 72*a* and/or in the first channel 70*a* to further securely maintain the first end 9*a* of the elongated member 9 in the channel 70*a* and the first securing end 60*a* in the first locking seat 60*a*. A substantially similar arrangement may be utilized to couple the second end 9*b* to the back cover 5.

Those skilled in the art will understand that other embodiments may be possible based upon the above description.

What is claimed is:

1. A book-toy combination, comprising:

a front cover, a back cover, and a plurality of pages therebetween, the front cover, back cover and plurality of pages being bound along one side thereof;

an elongated member having a first end and a second end, each of the first end and the second end being coupled to at least one of the front cover, the back cover, and at least one of the plurality of pages, the elongated member extending away from the at least one of the front cover, the back cover, and the at least one of the plurality of pages, the first end being provided at a predetermined distance from a second end; and at least one element sliding along the elongated member.

2. The book-toy combination according to claim 1, wherein the elongated member is coupled to the back cover.

3. The book-toy combination according to claim 1, wherein the at least one element rotates about the elongated member.

4. The book-toy combination according to claim 1, wherein the elongated member includes a handle.

5. The book-toy combination according to claim 1, wherein the back cover includes an outer face, and wherein the elongated member is coupled to the outer face of the back cover.

6. The book-toy combination according to claim 1, wherein the elongated member is fixedly coupled to the at least one of the front cover, the back cover, and the at least one of the plurality of pages.

7. The book-toy combination according to claim 1, wherein the elongated member is detachably coupled to the at least one of the front cover, the back cover, and the at least one of the plurality of pages.

8. The book-toy combination according to claim 1, wherein the elongated member includes a plastic hoop.

9. The book-toy combination according to claim 1, wherein the elongated member is composed of a semi-rigid material.

10. The book-toy combination according to claim 9, wherein the elongated member is posable.

11. The book-toy combination according to claim 1, wherein the at least one element has a predetermined shape.

12. The book-toy combination according to claim 11, wherein the at least first predetermined shape corresponds to a subject matter of the book.

13. The book-toy combination according to claim 11, wherein the at least one member includes at least one toy member.

14. The book-toy combination according to claim 13, wherein the at least one member includes a plurality of toy members.

15. The book-toy combination according to claim 1, wherein the elongated member extends over the periphery of the at least one of the front cover, the back cover, and the at least one of the plurality of pages.

16. The book-toy combination according to claim 1, wherein at least one of the front cover, the back cover, and the plurality of pages has a first predetermined shape.

17. The book-toy combination according to claim 16, wherein the first predetermined shape corresponds to a subject matter of the book.

18. The book-toy combination according to claim 17, wherein the at least one element has a second predetermined shape corresponding to a subject matter of the book.

19. The book-toy combination according to claim 18, wherein the first predetermined shape substantially corresponds to the second predetermined shape.

20. The book-toy combination according to claim 1, wherein the elongated member includes a first portion and a second portion, and wherein the elongated member is coupled to the at least one of the front cover, the back cover, and at least one of the plurality of pages by coupling the first portion to a first point on the at least one of the front cover, the back cover, and at least one of the plurality of pages and by coupling the second portion to a second point on the at least one of the front cover, the back cover, and at least one of the plurality of pages.

21. The book-toy combination according to claim 20, wherein the first portion includes a first end of the elongated member, and wherein the second portion includes a second end of the elongated member.

22. The book-toy combination according to claim 1, wherein the elongated member is coupled to a top edge of the back cover.

23. The book-toy combination according to claim 1, wherein the elongated member is composed of a semi-compressible material.

24. A book-toy combination, comprising:

a front cover, a back cover, and a plurality of pages therebetween, the front cover, back cover and plurality of pages being bound along one side thereof;

an elongated member coupled to at least one of the front cover, the back cover, and at least one of the plurality of pages, the elongated member extending away from the at least one of the front cover, the back cover, and the at least one of the plurality of pages; and at least one element sliding along the elongated member, wherein a first portion of the elongated member is received within a first channel in the back cover, and wherein a second portion of the elongated member is received within a second channel in the back cover.

25. The book-toy combination according to claim 24, wherein the first portion of the elongated member includes a first securing end, wherein the second portion of the elongated member includes a second securing end, wherein the first securing end fixedly secures the first portion of the elongated member within the first channel, and wherein the second securing end fixedly secures the second portion of the elongated member within the second channel.

26. The book-toy combination according to claim 25, wherein at least one of the first securing end and the second securing end includes at least one hook.

* * * * *